United States Patent [19]

Dahlgren

[11] Patent Number: 4,590,857

[45] Date of Patent: May 27, 1986

[54] INK METERING APPARATUS

[76] Inventor: Harold P. Dahlgren, 726 Regal Row, Dallas, Tex. 75247

[21] Appl. No.: 768,921

[22] Filed: Aug. 23, 1985

Related U.S. Application Data

[60] Continuation of Ser. No. 649,968, Sep. 12, 1984, abandoned, which is a continuation of Ser. No. 345,726, Feb. 4, 1982, abandoned, which is a continuation of Ser. No. 142,595, Apr. 22, 1980, abandoned, which is a continuation of Ser. No. 906,471, May 17, 1978, abandoned, which is a division of Ser. No. 779,647, Mar. 21, 1977, abandoned.

[51] Int. Cl.[4] ..... B41F 31/04; B41L 27/08

[52] U.S. Cl. ..... 101/350; 101/157; 101/364

[58] Field of Search ..... 101/148, 349, 350, 363, 101/366, 157, 169, 206, 207, 208, 210, 365; 118/261, 226, 262; 15/256.51, 256.5, 413

[56] References Cited

U.S. PATENT DOCUMENTS

| | | | |
|---|---|---|---|
| 491,240 | 2/1893 | Crompton | 101/169 |
| 1,154,002 | 9/1915 | Crump et al. | 101/425 |
| 2,148,456 | 2/1939 | Grossarth | 101/169 |
| 2,260,364 | 10/1941 | Case | 101/350 X |
| 2,534,320 | 12/1950 | Taylor | 118/413 X |
| 2,704,026 | 3/1955 | Rogge et al. | 101/157 |
| 3,037,451 | 6/1962 | Davis | 101/350 |
| 3,283,712 | 11/1966 | Chambon | 101/350 |
| 3,298,305 | 1/1967 | Noon | 101/350 |
| 3,486,482 | 12/1969 | Hunger | 118/413 X |
| 3,585,932 | 6/1971 | Granger | 101/350 |
| 4,007,682 | 2/1977 | Gundlach | 101/350 |
| 4,026,210 | 5/1977 | Merzagora | 101/350 |
| 4,041,864 | 8/1977 | Dahlgren et al. | 101/350 |
| 4,050,380 | 9/1977 | Pfizenmaier | 101/365 |

FOREIGN PATENT DOCUMENTS

| | | | |
|---|---|---|---|
| 154579 | 1/1951 | Australia | 118/261 |
| 2110299 | 9/1972 | Fed. Rep. of Germany | 101/365 |
| 26628 | of 1897 | United Kingdom | 101/169 |

*Primary Examiner*—J. Reed Fisher

*Attorney, Agent, or Firm*—Gerald G. Crutsinger; John F. Booth; Monty L. Ross

[57] ABSTRACT

An inker for a printing press in which an excess of ink is applied to the surface (45) of a resilient roller and the ink is metered by a metering member (10') to form a film of controlled thickness on the resilient roller surface. The metering member is a long strip including a polished metering surface and a polished support surface (26) which intersect to form a polished metering edge (25), the polished support surface (26) intersecting with a polished trailing surface (**28*a*) to form a polished trailing edge (28*b*). The metering edge (25) and trailing edge (28*b*) are closely spaced such that the entire support surface is indented into the resilient roller surface for metering a film (130) of ink and for assuring that the ink will separate cleanly from the metering member at the trailing edge (28*b*). The leading or metering edge (25) is indented into the resilient roller surface (45) further than the trailing edge (28*b*) which results in the formation of a film (130**), the thickness of which does not change substantially with a change in press speed.

8 Claims, 10 Drawing Figures

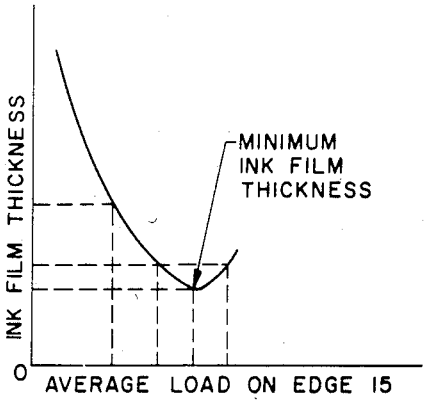
FIG. 5
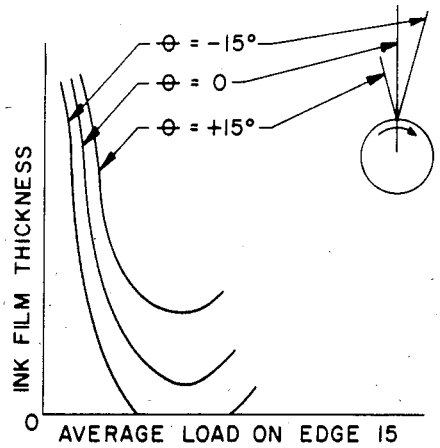
FIG. 6
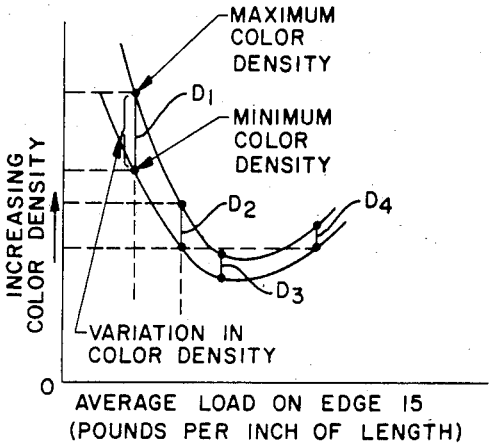
FIG. 7
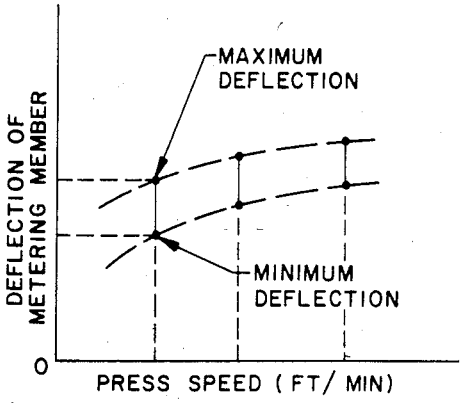
FIG. 8
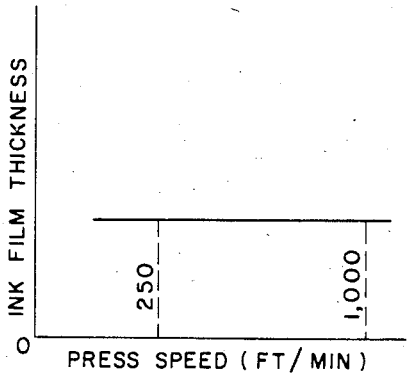
FIG. 9
MAXIMUM DIFFERENCE ±.03
| | | | | |
|---|---|---|---|---|
| .89 | .88 | .87 | .82 | .83 |
| .89 | .88 | .88 | .88 | .84 |
| .89 | .86 | .87 | .85 | .84 |
| .87 | .85 | .86 | .86 | .85 |
COLOR DENSITY
CONTROL "VERY TIGHT" IN RANGE OF ±.05
FIG. 10

INK METERING APPARATUS

This application is a continuation of application Ser. No. 06/649,968 filed Sept. 12, 1984, now abandoned; which is a continuation of Ser. No. 06/345,726, filed Feb. 4, 1982, now abandoned; which is a continuation of Ser. No. 06/142,595, filed Apr. 22, 1980, now abandoned; which is a continuation of Ser. No. 05/906,471, filed May 17, 1978, now abandoned; which is a divisional of Ser. No. 05/779,647, filed Mar. 21, 1977, entitled INK METERING APPARATUS, now abandoned.

BACKGROUND OF THE INVENTION

Inkers for printing plates which have achieved commercial acceptance generally comprise from two to four form rollers which are positioned in rolling engagement with a printing plate. Each of the form rollers is usually in rolling engagement with one or more vibrator rollers to which ink is applied by a multitude of rollers in a train of rollers of varying diameters arranged in pyramid fashion. Ink is delivered to the train of rollers over a ductor roller which oscillates into and out of engagement with a film of ink formed by a flexible doctor blade urged into engagement with the hard surface of an ink fountain roller by a multiplicity of ink keys.

The ink film formed on the ink fountain roller has been too thick and too irregular for application directly to a printing plate for quality printing. These inkers which include a multiplicity of rollers are intended to reduce the thickness of the ink film and to deliver a film of uniform thickness to the printing plate. However, since the ink film on each form roller is not totally replenished on each revolution of the form roller; image ghosting and ink accumulation and starvation is not eliminated.

The multiple roller inkers require complex drive trains and are relatively expensive to purchase initially and to maintain thereafter.

In an attempt to eliminate both the expense and the disadvantages of multiple roller inkers, many recent attempts have been made to develop inkers wherein a fresh film of ink is metered onto a form roller which is urged into pressure relation with a printing plate to eliminate the train of rollers, to eliminate image ghosting, and to eliminate ink accumulation and starvation.

U.S. Pat. No. 3,283,712 describes an inking system devised to overcome ghosting. The system comprises two rollers of substantially equal diameter urged together in pressure indented relation to form a nip, surfaces of the rollers adajcent the nip moving in opposite directions. One of the rollers was cleaned by a pair of doctor blades and the rollers were urged together such that the local pressure at any point selected along the contact generatrix or nip was greater than a "critical pressure threshold", such that, theoretically, one of the rollers carried a film of ink of constant thickness throughout the length of the roller to be applied directly to a printing plate without being contacted by equalizer rollers.

Ideally, a stationary metering unit requiring no drive in addition to that required for rotating a single form roller would appear to be a solution to the problems presented by previous inkers. Attempts have been made to employ doctor blades as ink metering units, but these attempts have universally met with failure. Doctor blades are successfully used as ink wiping units in inkers having a train of rollers for distributing and smoothing the ink, but difficulty is encountered when such blades are used as the sole ink metering unit for a resiliently surfaced form roller.

Printing ink is generally an oily viscous substance which is highly pigmented and formulated to be sticky or tacky so that the ink will properly adhere to image areas of the printing plate. When the image area of the printing plate transfers ink directly to paper or to a blanket cylinder which in turn transfers ink to paper, small paper fibers, lint and fragments of coating material may adhere to the surface of the plate cylinder. The plate causes the foreign substance to be applied to the surface of the ink applicator roller. If the surface of the ink applicator roller is moved directly into the reservoir and then wiped or scraped by a conventional doctor blade, the foreign substance tends to collect at the edge of the doctor blade which results in formation of an irregular film of ink on the surface of the roller. For this reason, in addition to the erratic behavior of the surface of the resilient roller under dynamic conditions, no inking device has been devised heretofore which is capable of supporting a doctor blade for metering a uniform film of ink directly onto the surface of a resilient roller in rolling engagement with a printing plate.

U.S. Pat. No. 3,298,305 discloses an inking mechanism having a stationary, rigidly supported edge held in a position to significantly indent a resilient roller surface such that a film forming portion on the inking mechanism would form a thin uniform film of ink which was delivered through a slot in the inking mechanism and applied to the roller surface. The edge was described as being positively locked in position to prevent any lifting by the ink film on the roller so as not to detrimentally affect the hydrodynamic effect.

U.S. Pat. No. 4,007,682 discloses a method of inking a resilient surfaced form roller wherein an ultra-thin doctor blade is mounted at a reverse angle to the ink to split the ink and apply the ink to the roller in the desired thickness when relative motion is provided between the roller and the doctor blade. The doctor blade is described as being flexible, for example, a blade constructed of Swedish steel having a thickness of 0.008 inches in one example and a thickness of 0.015 inches in another example.

The disclosure of U.S. Pat. No. 4,007,682 states that when an ink of high viscosity is used and the rate of relative motion between the roller surface and the edge of the blade is high, a sharp blade will "float" along on the ink surface, but the lead edge of the doctor blade should be cylindrical having a radius of curvature equal to one-half the thickness of the blade when less viscous inks are used. The disclosure states that the velocity of the roller surface relative to the doctor blade is adjusted to interact with the ink viscosity, blade geometry and downward force on the blade to cause the ink to be carried into the nip between the blade and the roller surface whereby its viscous resistance to shear forces creates an upward pressure causing the doctor blade to "float" over the ink film it produces. The surface speed of the roller is varied for varying the thickness of the film of ink formed thereon. The disclosure states that rotation of the inking roller at 68 inches per second provides a uniform coating of ink 5 microns thick and that when the rotation speed of the inking roller is increased to 172 inches per second a layer of ink 12 microns thick is formed.

The invention described herein addresses the problem of forming a film of printing ink of uniform thickness on a resilient roller surface and moving the film of ink into engagement with the image area on a printing plate while eliminating trains of rollers in inking systems, eliminating the necessity for consumption of excessive power for metering a thin uniform ink film, eliminating problems attendant to collection of "hickeys", providing a metering member which does not detrimentally stress a resilient roller surface so as to impart vibration to the resilient roller surface, and providing a metering member which forms a uniform film, the thickness of which is independent of press speed.

SUMMARY OF INVENTION

The improved inker which is the subject of this application comprises a resilient surfaced roller adapted to be urged into pressure indented relation with a printing plate, in combination with an improved liquid metering apparatus adapted to form a thin uniform film of ink on the surface of the resilient roller, the thickness of the film of ink being independent of the surface speed of the resilient roller.

The surface of the roller moving from engagement with the printing plate is moved through a reservoir of ink such that an excess of ink is applied to the surface of the roller. A metering member is positioned in relation to the resilient surface of the roller to form an orifice through which a thin uniform film of ink is extruded which adheres to the resilient surface of the roller.

The metering member is resiliently mounted such that a polished flexible edge thereon moves relative to the axis of the resilient covered roller and is urged toward the resilient surface of the roller to maintain a substantially constant pressure relationship relative to the roller surface along the entire length of the roller and circumferentially thereabout.

The polished flexible edge of the metering member is rigidly supported in a direction generally tangent to the roller surface and is shaped and oriented to deform the resilient roller surface to minimize wetting of a substantial surface area of the metering member downstream from the polished edge to cause separation of ink from the metering member adjacent the polished edge. The lower surface of the metering member is shaped and/or positioned such that ink on the indented resilient roller surface does not separate from the roller surface and attach itself to the lower surface of the metering member when rebounding from a compressed position occupied as a result of passing the flexible polished edge of the metering member.

Flow of ink in the reservoir toward the metering member is turbulent due to the structure of the metering member adjacent the reservoir, thus causing lint and other foreign matter to generally be rejected from an area of high pressure immediately adjacent the leading edge of the metering member. This lint and foreign matter is retained in the reservoir and therefore lodging of particles against the edge of the metering member is also minimized. Flow of ink carried by movement of the surface of the resilient roller toward the polished edge of the metering member experiences a rapid increase in pressure and flow becomes laminar immediately adjacent the polished edge. Velocity of the ink increases as it moves through an orifice between the resilient surface of the roller and the polished edge of the metering member. Immediately downstream from the orifice, the ink separates from the polished surface and is retained on the resilient surface of the roller.

The polished edge of the metering member is urged toward the resilient surface of the applicator roller by a static force in a range between about one and six pounds per linear inch of the length of the edge, the force being sufficient to indent the roller surface along the entire length of the roller surface and being dependent upon the modulus of elasticity of the resilient roller, the cover thickness, the viscosity of the ink and other characteristics of the ink. The polished edge of the metering member slightly indents the surface of the resilient roller, for example about 0.03 inches on a 40 Shore A durometer roller having a cover thickness of approximately 5/16 inches. As the roller rotates, the polished edge of the metering member moves relative to the axis of the roller to maintain a condition of equilibrium such that the edge forms an orifice which automatically moves radially relative to the axis of the roller to form a film of uniform thickness longitudinally of the roller surface and circumferentially thereabout although the roller surface is not perfectly round and not free of slight waviness.

A primary object of the invention is to provide an inking system for printing presses affording continuous precision control of the thickness of an ink film delivered to a printing plate to eliminate ghosting and resultant variation in color of printed images.

Another object of the invention is to provide an improved liquid metering member and support means associated therewith to position the metering member relative to a resilient roller surface for forming a liquid film on the roller surface, the thickness of the film being substantially independent of the speed of the roller surface.

Another object of the invention is to provide an improved ink metering member particularly adapted to be urged into relation with a roller such that foreign matter in ink moving toward the surface of the metering member and carried by the surface of the roller is diverted away from the metering member.

A further object of the invention is to provide a simple and efficient inking system capable of forming a thin continuous film of ink of uniform thickness longitudinally and circumferentially of a moving resilient roller surface, the system being stationary to operate without generating excessive heat and without expending excessive energy for driving the system.

Another object of the invention is to provide an improved method and apparatus for forming a uniform film of ink on the surface of a resilient roller wherein the ink is metered through an orifice defined between a flexible polished edge resiliently urged toward the resilient roller surface so that the orifice automatically moves radially of said roller such that the thickness of the film of ink is independent of the surface speed of the roller and does not substantially vary as the speed of the printing press is changed.

A still further object of the invention is to provide an improved method and apparatus for forming a uniform film of ink on the surface of a resilient roller by use of an edge mounted on a cantilever, the edge being moved into pressure relationship with an ink film on the roller surface past a threshold point where the ink film ceases to decrease in thickness when an increase in force is applied to the edge and begins to increase in thickness while becoming more nearly uniform.

Another object of the invention is to provide an inking sytem wherein a non-rotating metering member is positioned and adapted such that ink passing under the member upon being metered does not separate from itself and accumulate on the lower surface of the metering member to ultimately be pulled again to the metered film to destroy uniformity.

Another object of the invention is to provide an improved inking system in which a polished edge on a metering member is resiliently urged into pressure indented relation with a resilient roller surface such that vibration in the printing press is isolated from the polished edge to eliminate streaks in the ink film formed by the inking system.

Another object is to provide an inking system in which a polished edge on a metering surface is urged into pressure indented relation with a resilient roller surface such that the angle of the metering surface relative to a radius of the roller is adjustable to adjust the thickness of a film carried by the roller surface past the polished edged.

Other and further objects will become apparent upon referring to the following detailed description and to the attached drawings.

DESCRIPTION OF DRAWINGS

Drawings of a preferred embodiment of the invention are annexed hereto so that the invention may be better and more fully understood, in which:

FIG. 5 is a diagrammatic illustration showing that as force urging the metering member into pressure indented relation with a roller surface is increased a minimum ink film thickness is reached;

FIG. 6 is a diagrammatic view similar to FIG. 5 illustrating a family of curves;

FIG. 7 is a diagrammatic illustration showing variation in color density laterally across a printed sheet in response to changes in force urging an edge of the metering member into pressure relation with a resilient surface;

FIG. 8 is a diagrammatic illustration showing variation in position of an edge on the metering member as a resilient covered roller rotates at a constant speed and also at changing speeds;

FIG. 9 is a diagrammatic illustration that ink film thickness is independent of press speed; and FIG. 10 is a diagrammatic illustration showing the color density on a printed sheet.

Numeral references are employed to designate like parts throughout the various figures of the drawing.

DESCRIPTION OF A PREFERRED EMBODIMENT

Figure 1:
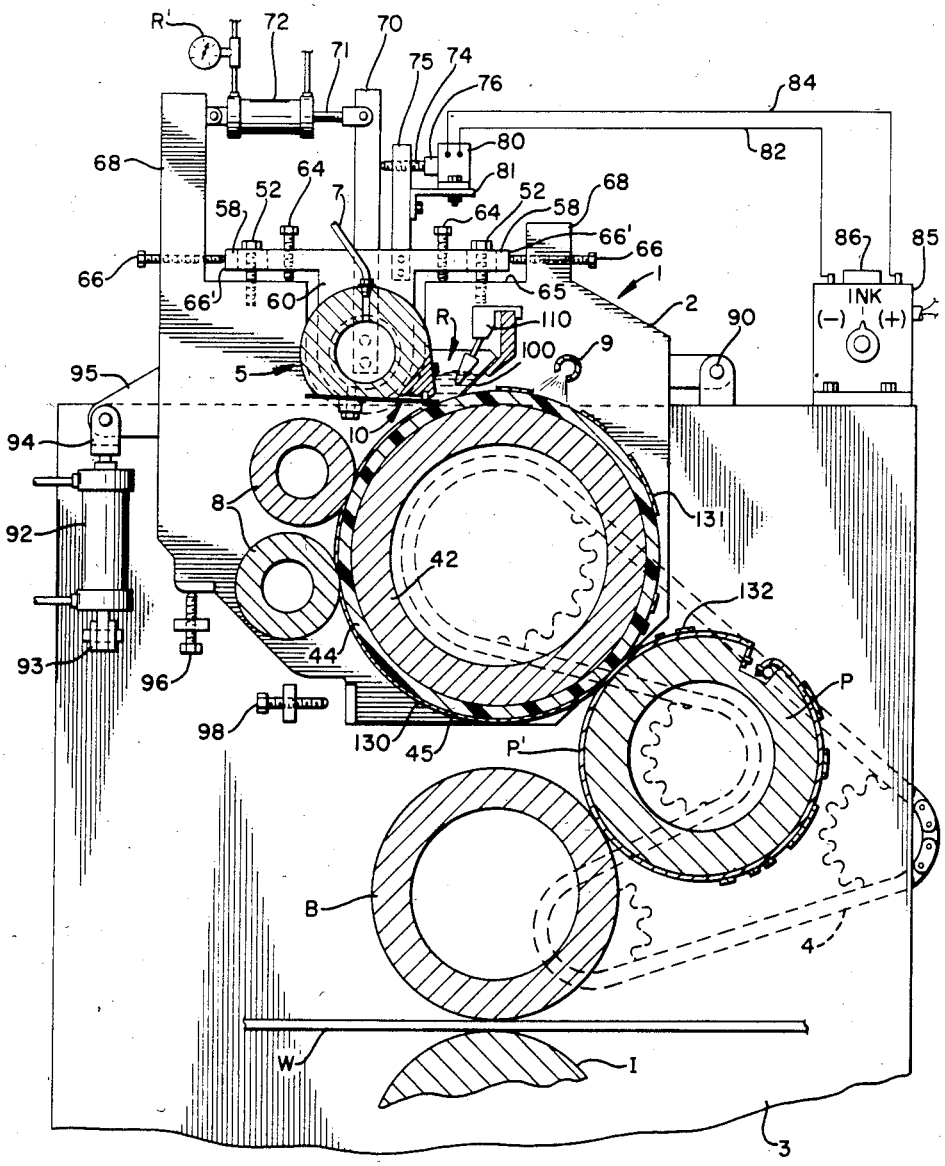
FIG. 1 is a cross-sectional view taken transversly through a printing press.
Figure 2:
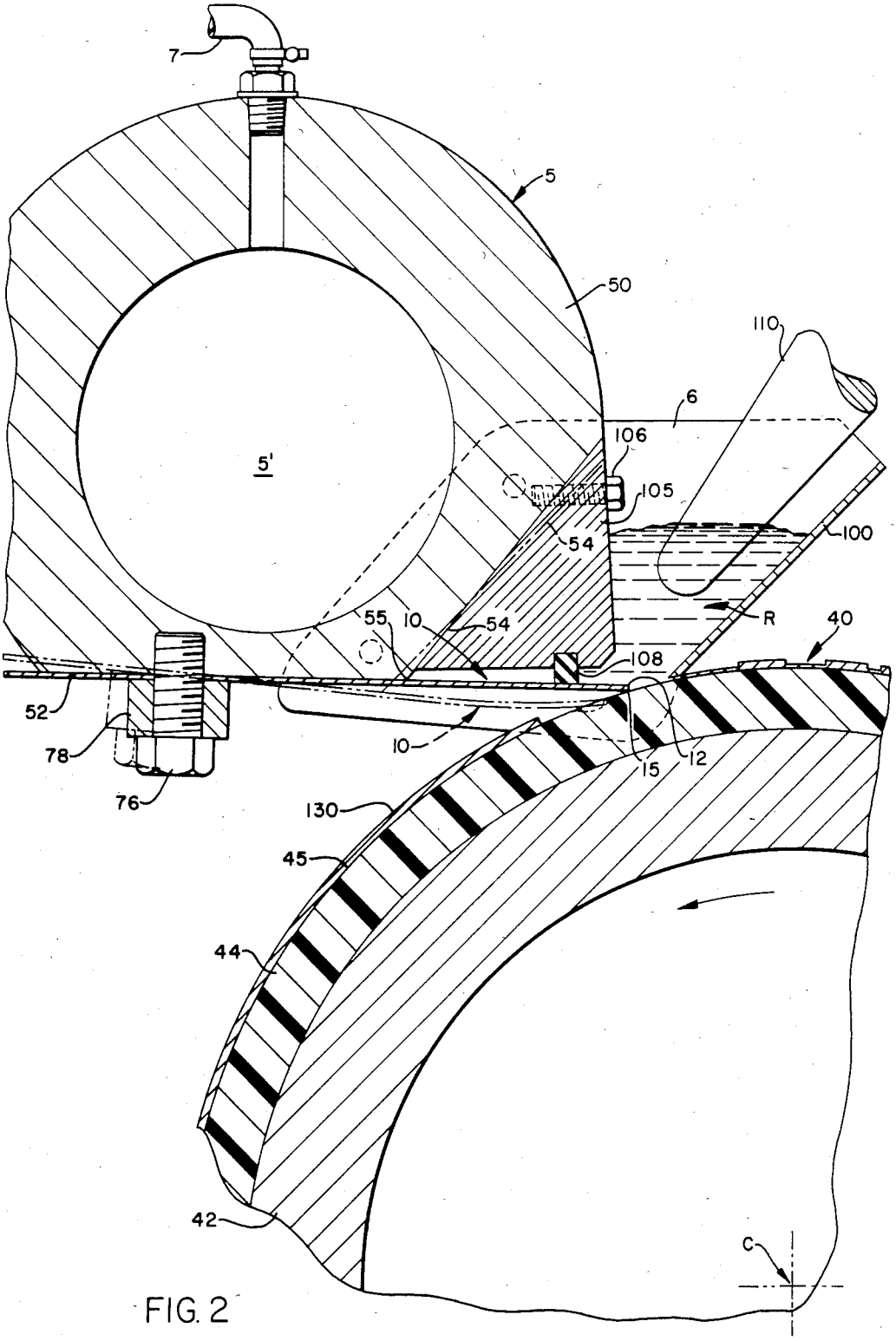
FIG. 2 is an enlarged fragmentary cross-sectional view illustrating the relationship of the metering member relative to a resilient covered roller.

Referring to FIGS. 1 and 2 of the drawing, the numeral 1 generally designates an inker having spaced side frames 2 movably secured to side frames 3 of a printing press having a conventional plate cylinder P, blanket cylinder B, and impression cylinder I mounted therein for printing on a web W or a sheet of paper.

Support means 5 is provided to adjustably secure metering member 10 between side frames 2 and to position metering member 10 in relation to a resilient covered applicator roller 40. Opposite ends of applicator roller 40 are rotatably secured to side frames 2 in suitable bearings and applicator roller 40 is driven by any suitable drive means such as a chain 4 drivingly connecting a sprocket on the plate cylinder to the sprocket on a clutch (not shown) at an end of applicator roller 40. The surface speed of applicator roller 40 is preferably equal to the surface speed of plate cylinder P. However, the surface speed of applicator roller 40 can be about ten percent faster or slower than the surface speed of plate cylinder P to facilitate cleaning non-image areas of the plate P.

End dams 6 are secured to support means 5 and are urged into sealing relation with opposite ends of applicator roller 40 and member 10 forming a reservoir R from which ink is metered onto the surface of applicator roller 40. One or more vibrator rollers 8 are positioned in rolling engagement with ink on the surface of applicator roller 40 for smoothing any surface irregularities which may appear in the ink film before the ink film is carried by the surface of roller 40 to the surface of a printing plate P′ on plate cylinder P. Vibrator rollers 8 are in rolling engagement with ink on the surface of applicator roller 40 and not only smooth surface irregularities, but also change a slick metered finish to smooth matt-like finish for conditioning the ink film for proper printing to an image on a printing cylinder.

It will be appreciated that as the surface of applicator roller 40 moves away from the surface of printing plate P′ the surface is submerged in ink and an excess of ink is applied thereto at the reservoir R.

If the inking system is employed for lithographic printing, wherein dampening fluid is applied to the surface of the printing plate P′ on plate cylinder P, means are provided for evaporating dampening fluid from the surface of roller 40 to prevent accumulation of excessive dampening fluid in reservoir R. As illustrated in FIG. 1 of the drawing, a hollow perforated tube 9 extends transversely between side frames 2 and has apertures formed therein through which dried compressed air is delivered for causing a stream of dry air to be directed toward the surface of roller 40. An end of tube 9 is connected by a hose to an air compressor (not shown).

Also, when dampening fluid is used with the inker of the present invention, a greater than normal proportion of alcohol to water may be employed to speed evaporation of the dampening fluid which remains on the applicator roller as it moves away from the printing plate. In fact, the dampening solution could contain more than the normal 5–25% alcohol to insure rapid evaporation of the dampening solution from the applicator roller during travel between the plate and the ink metering member.

As will be hereinafter more fully explained, to provide precision control of the viscosity of ink in reservoir R and to vary the viscosity of the ink in reservoir R, flexible tubes 7 are connected to deliver fluid, such as water of controlled temperature and at a controlled flow rate, into one end of passage 5′ in support member 5 and out of the other end of passage 5′.

For high speed web printing, the physical properties of ink film 130 formed between metering member 10 and resilient cover 44 of roller 40 may be controlled by temperature control of a fluid passing through vibrators 8 and through the passage in the core 42 of roll 40. It has been found that a high flow rate produces only a small temperature change along the length of a roller and that by monitoring and controlling the output temperature, heat can be dissipated and ink temperature controlled such that the physical properties of the generated film are held substantially constant throughout the length of a production run.

Therefore, by cooling and/or heating fluid passing through member 5 and roller core 42, the ink viscosity at the shear nip is controlled to maintain a constant desirable ink film for proper printing to plate P.

INK METERING MEMBER

Figure 3:
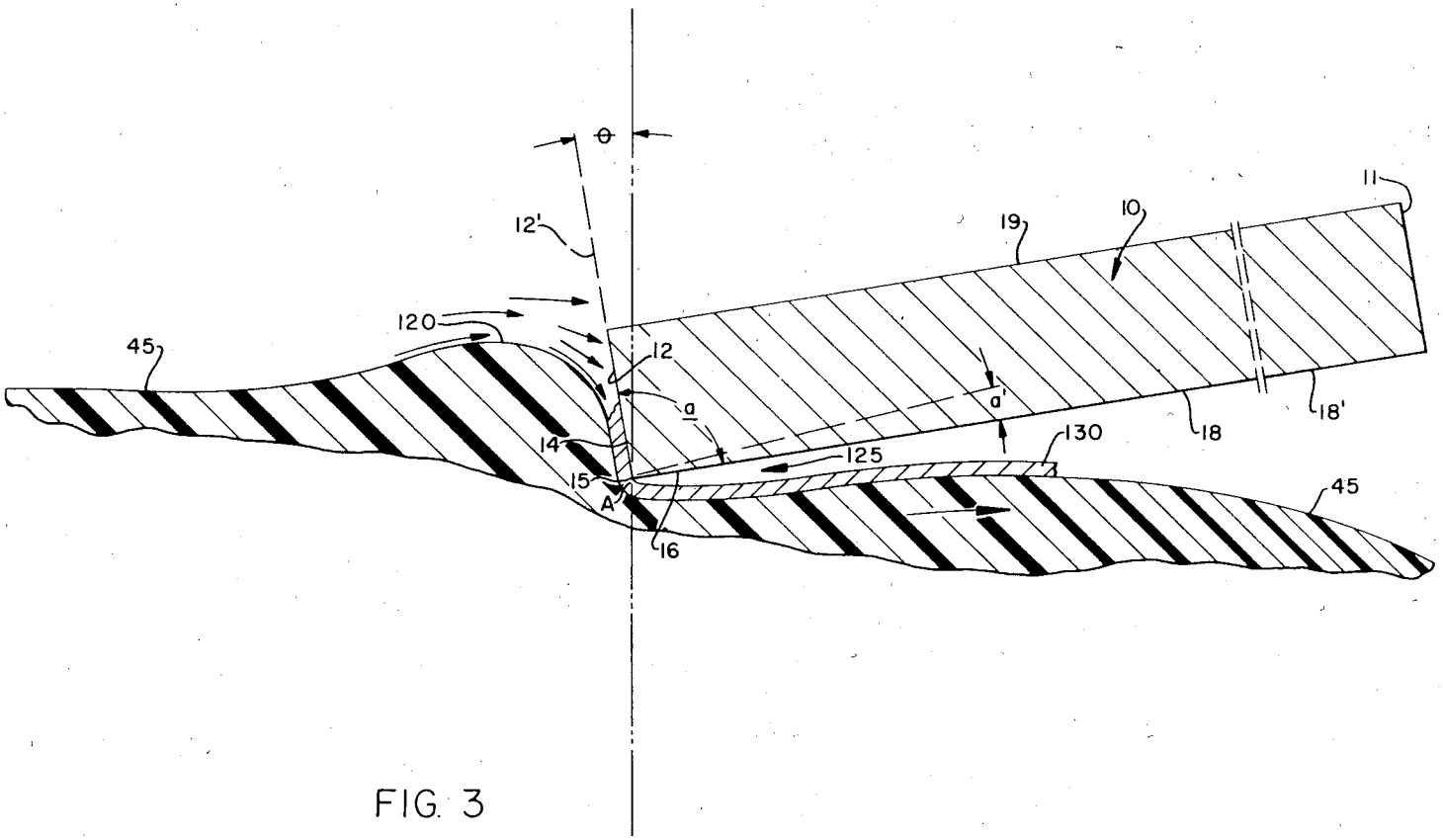
FIG. 3 is an enlarged diagrammatic illustration of a first embodiment of the metering member and a portion of the resilient surface of the applicator roller under dynamic conditions.
Figure 4:
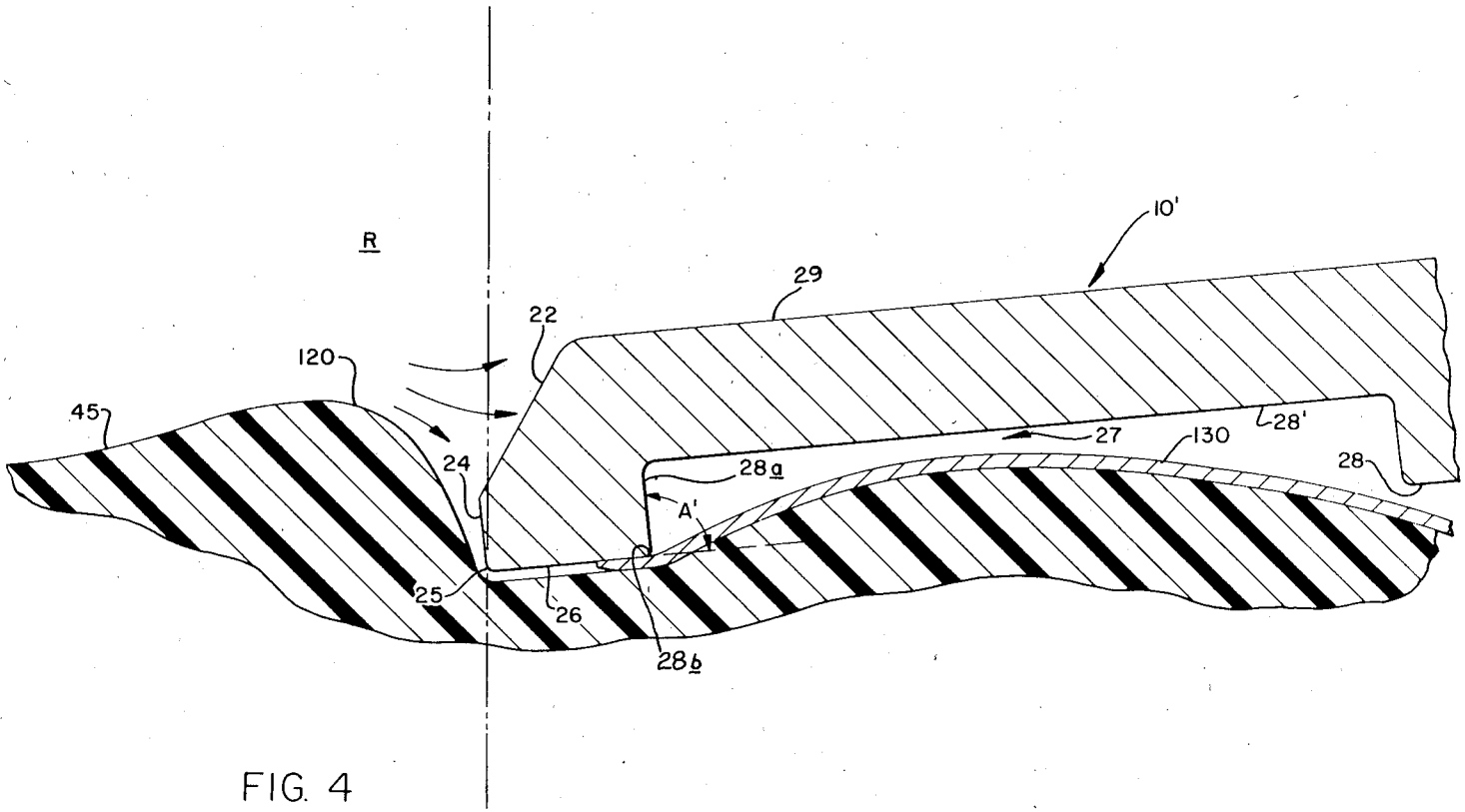
FIG. 4 is an enlarged diagrammatic view of a second embodiment of the metering member.

Two embodiments of ink metering member 10 are illustrated in FIGS. 3 and 4 of the drawing.

Referring particularly to FIG. 3, the ink metering member, generally designated by the numeral 10, has a smooth, polished, highly developed, precision edge 15 which is formed at the juncture of surfaces 12 and 18.

Edge 15 preferably extends in length for a distance within a range of from 10 to 100 inches, and is defined by polished portions 14 and 16 on the surfaces 12 and 18. Polished portions 14 and 16 meet to form a wedge having an edge bevel angle "a" of approximately 90 degrees. Although a 90 degree angle between the portions 14 and 16 has been found to be very effective for forming the precision edge 15, the edge may also be formed with the polished portion at other angles of less than 120 degrees and greater than 60 degrees.

The edge 15 is formed on relatively hard material, and normally metal is used. The material preferably has a hardness in a range between Rockwell C10 and Rockwell C60, and preferably about Rockwell C50.

Metering member 10 is preferably a resilient metallic material having a modulus of elasticity in a range between 1.5 and $30\times10^6$ psi, and preferably about $29\times10^6$ psi.

Metering member 10 has been formed with good results from a strip of stainless steel of the type employed in the construction of compressor valves which is commercially available from Uddeholm and distributed as UHB stainless 716. The stainless steel strip had a thckness of 0.031 inches and a width of 3.5 inches. The strip of material had a bright extra fine polished surface finish, deburred edges, extra accurate flatness and normal straightness. Since the strip of stainless steel material was hardened and tempered, it was resistant to corrosion in the presence of air, water and most organic acids in dilute form at room temperature.

The strip of stainless steel was selected for its hardness, flatness, resilience and fine surface finish to provide high wear resistance and good fatigue properties.

Prior to polishing, the edge 15 at the juncture of surfaces 12 and 18 defined a line consisting of ragged notches forming a ragged edge contour. To form a precision straight edge to define an unbroken line across the extent of metering member 10, several segments of the strip material were clamped together and surfaces 12 thereof were simultaneously ground, then honed with a fine-grit stone as a first step in forming polished edge 15.

A pair of strips from which metering members 10 were to be formed were then clamped in a vice with a spacer between the strips, surfaces 12 on each of the strips being positioned in a common plane so as to support a sanding block. Surfaces 12 on each of the strips were sequentially smoothed with sandpaper having grit sizes 320, 400 and 600 and then polished with crocus cloth.

As a third step, the pair of stainless steel strips were positioned on a flat horizontal surface such that each surface 12 was adjacent the other surface 12, the surface 19 on each strip being supported on a spacer such that edge 12 was inclined at an angle of about 0.2 degrees from a vertical line. Portion 16 of each surface 18 was sequentially smoothed with sandpaper having grit sizes 320, 400, and 600 and then polished with crocus cloth.

If a feather edge forms on the metering member while portions 14 and 16 of surfaces 12 and 18 are being sanded and polished, the feather should be removed. When the feather, or wire-like irregular edge is removed, a microscopic curve is formed on the edge. Thus, in the process of polishing or "sharpening" the edge 15, the acuteness of the edge should be altered somewhat to form a non-cutting, non-film-piercing edge. This process produces a fine, continuous, smooth, straight, polished, highly developed edge 15 having minimal surface irregularities. There should be no small notches or protrusions in the edge. The developed edge 15 formed by polished portions 14 and 16 of surfaces 12 and 18 is a very fine edge which has been polished to bring it to a highly developed finish, and as nearly perfect condition as possible.

Edge 15 is finished to a surface finish approximating that of the edge of a razor blade. However, it will be appreciated that the angle a between polished portions 14 and 16 of surfaces 12 and 18 is significantly greater than the bevel angle a' on a razor and thus a blunt, non-cutting and non-piercing edge is formed. Actually, surface 14 blends into surface 16 through edge 15 to form a continuous polished surface adjacent edge 15.

The material used to form the edge 15 must not only be hard and capable of being formed to provide a blunt, fine, polished, unbroken edge, but the material must also be flexible along the length of the edge 15. In fact, the edge 15 must be quite flexible in a lengthwise direction so that when urged into pressure indented relation with the resilient surface of applicator roller 40 the edge 15 will be flexed, yielding to the influence of the surface of roller 40, to conform the edge 15 and the surface of roller 40 to form a uniform indented area along the length of roller 40. As will be hereinafter more fully explained, the surface of roller 40 has a thickness of approximately 0.25 inches and a resilience of about 40 SHORE A durometer. This flexure of edge 15 to obtain conformation with the surface of roller 40 should be possible without excessively indenting the surface of the roller when in a static condition.

The edge 15 on metering member 10 should be mounted so that it is resiliently urged toward the surface of the applicator roller 40 and is free for movement in a direction radial to the applicator roller. Also, the edge 15 must be rigidly supported in a direction substantially tangent to the applicator roller surface.

The ideal support for the edge 15 is a flexible cantilever beam which supports the edge 15 and provides the required bias and rigidity. Although the edge 15 may be a part of a separate element which is attached to a cantilever beam, it is preferable to form the edge 15 on the beam so that the two are an integral unit. To accomplish this, the beam must be constructed of a material of the type necessary for the edge 15 and must be flexible in two directions; namely, along the length of the edge and also along the width of the strip or the length of the cantilever beam.

The ink metering member illustrated in FIG. 3 of the drawing, wherein the edge 15 is formed on the unsupported end of the cantilever beam, has a substantially rectangular cross section bounded by surfaces 11, 12, 18 and 19. Surface 12 lies in a plane 12' which intersects a plane 18' in which surface 18 lies when the cantilever beam is in a non-flexed condition. Planes 12' and 18' intersect at an apex "A" which is a straight line.

As an example, the cantilever beam which includes the edge 15 may be formed from a thin, flexible, elongated stainless steel strip, as hereinbefore described, having a thickness of 0.031 inches and a width of 3.5 inches. The width of the beam, or the length of the strip of material, will preferably be within the range of from 10 to 100 inches, and the beam is supported to be flexible along the length of edge 15 as well as along the length of the cantilever beam. The modulus of elasticity E of the beam may be, for example $29\times10^6$ psi, which represents the stiffness of the material; that is, its resistance to deformations. When combined with the moment of inertia I, the EI factor represents the stiffness of the cantilever beam.

The specific dimensions and characteristics of the metering member 10 are presented by way of explanation, and such dimensions, characteristics and mounting may vary to meet specific conditions. Consequently, preferable ranges have been provided herein.

A second embodiment, generally designated by the numeral 10', is illustrated in FIG. 4 of the drawing.

The ink metering member 10' will finally have a fine, polished, highly developed precision edge 25 which is formed at the juncture of polished metering surface 24 and polished support surface 26 using the method hereinbefore described for forming edge 15 on member 10.

Metering member 10' differs from metering member 10 primarily in that a groove or relieved area 27 is formed in the lower surface 28 of the strip of material from which metering member 10' is formed.

The strip of material from which metering member 10' is formed is preferably stainless or high carbon steel having a thickness of about 0.050 inches and a width of about 3.5 inches.

The portion of the strip of material which will be polished to form a first leading polished edge 25 is masked and the metallic material adjacent thereto is removed by chemically milling to remove a portion of the metal without relieving or creating stress that would cause the strip of material to warp.

Surfaces **28*a* bounding the support area 26 are smoothed by grinding to remove approximately 0.003 inch of rough surface material. Surfaces bounding the relieved area 27 may then be electropolished to provide a very smooth surface finish. These surfaces may be electropolished by making the member 10'** the anode and submerging it in electrolyte containing phosphoric acid and butyl alcohol so that the high points on the surfaces will be dissolved in the electrolyte.

If the thickness, the distance between surfaces 28 and 29, of the strip of material is 0.050 inches, the depth of the relieved area 27 is preferably about 0.020 inches such that the thickness of the material between surface 28' and surface 29 is approximately 0.030 inches.

Surface **28*a* intersects the polished support surface 26 at an angle A' in a range between 30 and 90 degrees as shown to form a second trailing polished edge 28*b***.

The upper portion of surface 24 of metering member 10' is bevelled at an angle of approximately 30 degrees to form surface 22.

In the illustrated embodiment of metering member 10', polished surface 24 extends upwardly from polished edge 25 a distance approximately equal to the depth of relieved area 27, or approximately 0.020 inches to intersect surface 22. It should be readily apparent that polished support surface 26 supports the polished edge 25. If surfaces 24 and **28*a* are parallel, surface 26 can be refinished without changing the load bearing characteristics of the polished edge portion 25 of the metering member 10'**.

However, it should be readily apparent that surface 22 may be formed to extend through polished edge 25, if it is deemed expedient to do so, such that the polished portion 24 and surface 22 would lie in a common plane. As illustrated in FIG. 4, the distance between the first edge 25 and the second edge **28*b*, measured along surface 26, is less than the distance between the upper surface 19 and the lower surface 28 of strip 10'. It should be noted that the distance between the edges 25 and 28*b* is greater than the depth of relief 27**.

The relief angle A' should be sufficient to cause an ink film carried by the surface of roller 40 to depart and separate from surface 26 adjacent the second trailing polished edge **28*b* without accumulating either on surface 26 or 28*a*** to cause ultimate dripping of the accumulated ink to cause non-uniformity.

APPLICATOR ROLLER

The applicator roller 40 comprises a hollow, rigid, tubular, metallic core 42 having a resilient non-absorbent cover 44 secured thereto, the cover having a uniformly smooth and resilient outer surface 45. The cover 44 on applicator roller 40, while being resilient, is relatively firm, for example in a range between 30 and 90 Shore A durometer.

The cover 44 on applicator roller 40 is preferably formed of a resilient urethane, polyurethane or rubber-like material attached to a metallic core 42. It should be readily apparent from FIG. 4 of the drawings that the trailing edge **28*b* and the leading metering edge 25 are both indented into resilient roller surface 45 and that surface 26** is entirely indented.

The cover 44 on applicator roller 40 should have high tensile strength, excellent tear and abrasion resistance, and resistance to oils, solvents and chemicals. The cover should, furthermore, have low compression set, good recovery, and uniform ink receptivity. A suitable cover can be formed using a resin commercially available under the registered trademark "Solithane" available from Thiokol Chemical Corporation of Trenton, N.J., in combination with suitable plasticizers to form a resilient cover of about 40 Shore A durometer.

After a resilient cover 44 has been formed, the roller may have a slick glazed outer skin or film over the surface thereof which is removed by grinding. After grinding, the plastic surface is sanded by using 180 grit sandpaper to form a surface of uniform roughness over the surface 45 of the resilient cover 44. Microscopic reservoirs into which ink is attached, assure that a continuous film of ink is maintained on the surface 45 of applicator roller 40. Final finishing using various sandpapers to 400 grit is done to insure a velvet smooth surface free of "orange peel" or other surface irregularities. As will be hereinafter more fully explained, adhesive force between molecules of ink and molecules of the surface 45 of cover 44 must exceed cohesive force between ink molecules to permit shearing the ink to form a controlled film of ink on the surface 45 of applicator roller 40

It will be appreciated that it is physically impractical, if not impossible, to construct roller 40 such that surface 45 is perfectly round in a circumferential direction, perfectly straight in a longitudinal direction, and precisely concentric to the axis of core 42. The straightness of surface 45 on roller 40 can be economically held within a tolerance of about 0.002 inches along the length of roller 40 and the radial eccentricity can be economically held within a tolerance of about 0.0015 inches.

A Shore A durometer test is generally used to indicate the hardness of a resilient roller cover by measuring resistance to penetration at a constant temperature of about 76 degrees F. while the resilient cover is stationary. The apparent hardness of a resilient surface under dynamic conditions deviates radically from the hardness indicated by the durometer test under static conditions. The spring constant of a resilient material also increases slightly as deformation increases.

As the frequency of loading of a resilient member increases, the dynamic modulus or apparent modulus of elasticity increases causing the cover to appear as a harder, stiffer material. However, cyclic loading of a resilient member results in generation of internal heat, with the increase in temperature resulting in a decrease in the durometer and therefore the modulus of elasticity of the resilient cover.

Further, since the surface 45 of cover 44 on roller 40 is preferably in pressure indented relation with the surface of a plate cylinder, the plate cylinder having a gap extending longitudinally thereof, this cyclic loading will result in generation of heat at an irregular rate circumferentially of the surface 45. Such temperature differences over surface 45 may cause an appreciable variation in the radial distance from the axis of the roller 40 to points over the surface 45, because the coefficient of thermal expansion of elastomeric materials employed for forming resilient roller covers is several times the coefficient of thermal expansion of steel.

As shown, roller 40 can be different in diameter than the plate cylinder P without adversely affecting metering of the film 130 since metering member 10 produces a continous ribbon of ink regardless of the prior impression and regardless of thermal changes within the roller cover 44.

SUPPORT STRUCTURE

Referring to FIG. 1 of the drawing, support means 5 for supporting metering member 10 in cantilever fashion comprises an elongated rigid support bar 50 having a ground and true flat face 52 on one side thereof and a surface 54 angularly disposed relative to flat face 52 forming a shoulder 55 which extends longitudinal of support bar 50. Journals 56 extend outwardly from opposit ends of support bar 50 and are rotatably secured in self-aligning bushing 57 in bearing blocks 60 having outwardly extending projections 58 adjacent opposite sides thereof.

Each of the projections 58 has an elongated slot formed therein through which anchor bolts 52 extend for securing bearing blocks 60 to inker side frame 2.

Four elevating screws 64 extend through threaded passages in projections 58 on bearing blocks 60 and engage surface 65 on inker side frame 2 for movement of support bar 50 in a vertical direction, as illustrated in FIG. 1.

Lateral adjustment screws 66 extend through threaded aperture in outward extending lugs 68 on inker side frame 2 and engage end surface 66' on projections 58.

From the foregoing it should be readily apparent that the position of bearing block 60 is adjustable vertically and horizontally, as viewed in FIG. 1 of the drawing, for movement of support bar 50 relative to the axis C of roller 40.

An arm 70 is bolted or otherwise secured to the end of journal 56 on support bar 50 and is urged by a piston rod 71 of fluid pressure actuated cylinder 72 into engagement with an end of a stop screw 74 threadedly secured to an arm 75 bolted or otherwise secured to bearing block 60. It should be readily apparent that support bar 50 is rotatable relative to bearing block 60 by adjustment of the position of the end of stop screw 7 relative to arm 75.

Pressure regulator R' is installed in order to set inlet pressure in cylinder 72 sufficient to hold arm 70 firmly against screw 74 for all indentations of edge 15 into surface 45 of cover 44.

Metering member 10 is secured to the flat surface 52 on support bar by bolts 76 extending through spaced apertures in clamp member 78, through oversized spaced apertures extending through the cantilever beam adjacent the rear edge 11 thereof. Bolts 76 are threadedly secured in threaded passages formed in support bar 50. Bolts 76 and clamp 78 cooperate such that the metering member 10 is uniformly attached or supported by support bar 50 such that the edge 15 has a uniform spring rate along its length.

In the embodiment of the apparatus illustrated in FIG. 1, stop screw 74 is remotely controlled by a direct current electrically driven motor 80 secured to arm 75 by a support bracket 81. If it is deemed expedient to do so, a gear reducer may be positioned between motor 80 and screw 74 to further control the speed of rotation of screw 74. A splined coupling 76 is connected between screw 74 and the output shaft of motor 80. Motor 80 is is commercially available from Globe Industrials Division of TRW, Inc., of Dayton, Ohio.

Conductors 82 and 84 extend between motor 80 and motor position control unit 85. Motor position control unit 85 is of conventional design and comprises a direct current source and a three position switch.

Motor position control unit 85 has a digital readout indicator 86 associated therewith to indicate the position of a rotary potentiometer (not shown) at the end of stop screw 74 which engages arm 70 to provide visual indication of the position of the support 50 for metering member 10 or metering member 10'. Motor position control unit 85 is secured to the side frame 3 of the printing press in the embodiment illustrated in FIG. 1 of the drawing. However, an additional motor position control unit 85 is preferably positioned adjacent the delivery end of the printing press so that the position of metering member 10 can be adjusted remotely as printed sheets are inspected to adjust color density of ink as required.

Inker side frames 2 are pivotally secured by a shaft 90 to press side frames 3 adjacent opposite sides of the printing press. A fluid pressure actuated throw-off cylinder 92 is pivotally secured to lugs 93 secured to side frames 3 of the printing press and has a piston rod 94 pivotally secured to lug 95 welded or otherwise secured to inker side frames 2. An on-stop adjustment screw 96 is threadedly secured to a lug secured to the press side frame 3 and is positioned to engage inker side frame 2 when pressure between the surface 45 of applicator roller 42 and printing plate P' has been properly established. An off-stop adjustment screw 98 is threadedly secured to a lug welded or otherwise secured to printing press side frame 3 to engage inker side frame 2 when the piston rod 94 in throw-off cylinder 92 is extended to thereby separate surface 45 on applicator roller 40 from the surface of printing plate P'.

As hereinbefore described, end dams 6 are urged into sealing relation with opposite ends of applicator roller 40 and define opposite ends of reservoir R. An ink retainer member 100 is positioned in sealing relation with the surface 45 of applicator roller 40, as illustrated in FIGS. 1 and 2 of the drawing, and has opposite ends secured to end dams 6. The lower edge 102 of ink retainer member 100 is preferably spaced slightly from surface 12 on ink metering member 10, for example 0.025 inches.

Ink retainer member 100 defines the entrance side of reservoir R.

The exit side of reservoir R is defined by member 105 secured to support bar 50 by bolts 106. The lower seal 108 adjacent member 105 is positioned adjacent the upper surface 19 of metering member 10 to prevent flow of ink from reservoir R onto the upper surface 19 of metering member 10 to form an area of stagnation in which ink ceases to flow. Since ink is thixotropic, the viscosity of ink is significantly reduced when the ink is in motion as compared to the viscosity of ink which is not in motion.

As illustrated in FIG. 1 of the drawing, an ink agitator 110 is secured to ink retainer member 100 for agitating ink in reservoir R.

Ink agitator 110 is of conventional design and is commercially available from Baldwin-Gegenheimer of Stamford, Conn.

The ink agitator 110 generally comprises a rack and pinion which extends longitudinally across the upper portion of the reservoir R and carries a mixing head driven by a chain which is driven by a constant speed motor. As the mixing head approaches an end dam 6 adjacent one end of applicator roller 40, it reverses direction and moves to the other end of the reservoir. The agitator rotates within the ink to laterally stir, or shear ink to prevent irregularities in viscosity along said reservoir.

OPERATION

The operation and function of the apparatus hereinbefore described is as follows:

Metering member 10 is aligned and attached to the face 52 of support bar 50 by bolts 76. Anchor bolts 52 are loosened to permit movement of bearing block 60 relative to inker side frame 2.

Lateral adjustment screws 66 are employed for moving bearing block 60 relative to applicator roller 40 for alignment of edge 15 on metering member 10 relative to surface 45 on resilient cover 44 of applicator roller 40.

Elevating screws 64 are employed for adjusting the angular relationship between surface 12 on metering roller 10 relative to a radius of applicator roller 40.

After edge 15 on metering member 10 has been aligned with the surface of applicator roller 40 and the angular relationship between surface 12 and a line extending radially of applicator roller 40 has been established, anchor bolts 52 are tightened, rigidly securing bearing blocks 60 relative to side frames 2. Edge 15 is now position in "kiss" contact with the surface 45 on applicator roller 40. An amount of ink in excess of that needed to ink the plate P' on the plate cylinder P is provided from the reservoir R to the surface of the applicator roller which is approaching metering surface 12 on metering member 10.

After edge 15 has been moved into "kiss" contact with the surface 45, stop screw 74 is rotated thereby rotating support bar 50 from the position illustrated in full outline in FIG. 2 of the drawing to the position illustrated in dashed outline.

This results in deflection of the cantilever beam and the flexible polished edge 15 is urged into pressure indented relation to conform with the resilient surface of applicator roller 40. Rotation or roller 40 now moves ink from reservoir into contact with edge 15 and metering surface 12 thus shearing ink of finite thickness on the surface 45 to a film 130 which may be altered in thickness as will be hereinafter more fully explained.

Assuming that edge 15 is mounted on a cantilever beam rigidly supported at one end, the equation of the elastic curve is $Y=F(2L^3-3L^2x+x^3)\div 6EI$.

In the prototype, a distance between shoulder 55 and metering surface 12 on metering member 10, which would be the unsupported end the cantilever beam, was 1.625 inches, the distance between surfaces 18 and 19 was 0.031 inches and a static load of four pounds per inch of width was applied at the edge 15. The modulus of elasticity E of the metering member 10 was $27\times 10^6$ psi.

The moment of inertia I of a rectangular area is equal to $bh^3\div 12$, where b is equal to the width of the base of the rectangular area and h is equal to the height of the rectangular area. The moment of inertia I of metering member 10 having a thickness of 0.031 inches was calculated to be $2.4\times 10^{-6}$ per inch of width of the cantilever beam.

At the unsupported end of the cantilever beam, x is equal to 0, and therefore, the deflection Y is equal to $FL^3\div 3\ EI$. Therefore, it was calculated that the deflection of the unsupported end of the cantilever beam should be approximately 0.088 inches when a load of four pounds per inch of width is applied to the edge 15. Therefore, it was concluded that the spring constant for the cantilever beam would be 0.022 inches of deflection per pound of force applied to the edge 15 or 45 pounds per inch of the width of edge 15.

It is, of course, appreciated that the equation of the elastic curve set forth above is only approximate for calculating the deflection of the edge 15 since metering member 10 is not rigidly supported or clamped at the shoulder 55 on support bar 50. However, it will be readily apparent that edge 15 is resiliently urged in a direction radially of applicator roller 40.

The deflection or the distance moved by the edge 15 on metering member 10, in the above example, was measured to be 0.20 inches when an average static force of four pounds per inch was applied to edge 15. Dividing the force of four pounds per inch by the deflection of metering member 10 reveals that the spring constant of metering member 10 is low and approximately 20 pounds per inch of deflection. The spring constant calculated from the actual deflection of resilient member 10 differs from the approximate spring constant calculated above. However, the differences in the spring constant as approximately calculated and as actually measured was predicted.

As will be hereinafter more fully explained, the combined distance that the edge 15 is deflected plus the distance that edge 15 is indented into the roller surface should be substantially greater than the maximum space between points on roller surface 45 and edge 15 when the surface and the edge are urged into kiss contact. For example, irregularities or manufacturing imperfections in roller surface 45 and slight waviness of edge 15 might result in a maximum deviation of 0.002 inches error such that the surface 45 and edge 15 do not conform when first touched together. If edge 15 is deflected 0.20 inches and indented into surface 45 a distance 0.030 inches, the initial deviation of 0.002 would be about 1% of the.combined distance of 0.23 inches. Since edge 15 and cover 44 are resilient, the edge and the surface will flex and conform to each other. When thus conformed, pressure along the stripe area will be substantially constant and the affect of small differences will be insignificant.

The combined distance of deflection and indentation is preferably more than ten times the initial deviation, such that the maximum error after the edge 15 and surface 45 are urged into pressure indented relation will be less than ten percent, to maintain a ink film thickness which will print what is considered by printers as acceptable uniformity of color density. However, for what is referred to as "very tight" control, color density should not vary more than five percent over the surface of a sheet.

As illustrated in FIG. 3 of the drawing, the edge 15 on metering member 10 is urged into pressure indented relation with the surface of applicator roller 40 such that the resilient material is stacked up, up-stream from surface 12 forming a bulge or wave 120 in the cover 44 while a groove or channel 125 is formed in the cover downstream from edge 15. This forms an orifice through which ink is extruded; the orifice being bounded on one side by a portion of surface 12 and edge 15 and bounded on the other side by a portion of the surface 45, probably between the crest of the bulge 120 and the portion of the surface 45 immediately adjacent polished edge 15. As the cantilever beam permits the flexible edge 15 to follow the contour of the applicator roller, the orifice automatically moves radially relative to the axis C of the applicator roller 40. Since the orifice is formed by the cooperation of the opposing flexibly biased edge 15 and resilient surface 45 of the applicator roller, this movement is desirable if a constant pressure relationship is to be maintained on the ink extruded through the orifice. The surface of the applicator roller 40 will constantly change in contour as the roller rotates due to elastic memory, temperature changes, and variations in the dynamic modulus of elasticity, as hereinbefore discussed. Consequently, it is important that the edge 15 automatically move radially and flex lengthwise to follow this changing contour.

It should be noted that ink carried by the surface 45 of applicator roller 40 impinges against metering surface 12 creating a region of tubulent flow adjacent the crest of the bulge 120 in the resilient roller surface. Thus, although edge 15 is resiliently urged downwardly as viewed in FIG. 3, metering surface 12 is shaped and positioned to prevent lifting of edge 15 by hydrodynamic forces exerted on metering member 10 by the ink. This condition is established by positioning polished edge 15 such that it is closer to the central axis C of applicator roller 40 than any other point of metering member 10. The blunt polished edge 15 favorably deforms the resilient cover 44 on applicator roller 40 to form a metering orifice for forming a film of ink of precisely controlled thickness.

Surface 18 on metering member 10, immediately downstream from polished edge 15 is positioned so that the metered film of ink is in contact with metering member 10 only at edge 15 to cause the ink film 130 to immediately separate from metering member 10 to prevent trailing of the ink along surface 18 which would result in accumulation of ink, dripping, and consequently, erratic flow which would destroy the uniformity of film 130.

In the embodiment of metering member 10 illustrated in FIG. 4 of the drawing, the lower surface of metering member 10' has been formed such that surface **28*a* at the heel of polished surface 26 and bounding relieved area 27 is angularly disposed relative to the direction of movement of ink film 130 such that roller surface 44 cannot rebound to a position wherein ink film 130 contacts surface 28'**.

Thus in the embodiment of the invention illustrated in FIG. 3 of the drawing as well as in the embodiment illustrated in FIG. 4 of the drawing, the metering member is shaped or positioned to cause ink film 130 to immediately separate from the metering member prior to the surface of the metering member returning to its relaxed, non-indented, position.

During testing of the apparatus hereinbefore described, it was discovered that as force urging edge 15 into pressure indented relation with surface 45 is initially increased, the thickness of film 130 is decreased to a minimum thickness; and then, with a further increase in force, the film 130 begins to increase in thickness.

Referring to FIG. 5 of the drawing, it will be noted that this surprising phenomenon occurs as force urging edge 15 on the cantilever beam metering member 10 toward the surface of roller 40 is increased. When a light force per linear inch of the length of edge 15 was employed for urging edge 15 into pressure relation with surface 45, color density decreased as load was applied and was uniform circumferentially of the surface 45 on roller 40. However, with this light loading, color density was not uniform laterally across the length of roller 40. As the force was increased, the ink film thickness on the roller was reduced until a somewhat heavier load per inch of the width of edge 15 was reached. Ink film thickness then began to increase as force urging polished edge 15 toward the central axis C of roller 40 was increased. Otherwise stated, as force was increased, the film thickness first was reduced and then began to increase as further load was applied. However, color density became extremely uniform laterally across the length of roller 40 when the load approached a static average force of four pounds per inch on the edge 15.

This phenomenon, where at a threshold pressure, the ink film thickness suddenly ceases to decrease and begins to increase as force on the edge 15 becomes higher has been observed when the edge 15 constitutes the lower forward edge of a cantilever beam member. FIGS. 3 and 4 show metering member 10 and 10' in such indented relation with surface 45 of roller 40 at a position such that edge deflecting load, pressure and indentation and therefore, ink film thickness (which determines color) is substantially constant.

Referring to FIG. 5, it should be observed that the thickness of ink film 130 varies as a function of the indentation of polished edge 15 into resilient surface 44 of applicator roller 40. As described above, as the indentation increases, the thickness of ink film 130 decreases rapidly to a minimum and then begins increasing. Irregularities or imperfections in surfaces on metering member 10 and applicator roller 40 are easily seen in the metered ink film 130 until positioned edge 15 is indented to a point where the variation in edge deflection along the length of edge 15 is small, as related to the total deflection, for example, less than ten percent. At this point, the ink film becomes more regular and uniform and remains substantially uniform as polished edge 15 is further deflected and indented into the surface of applicator roller 40.

It has been observed that the thickness of the minimum ink film, as depicted at the bottom of the curve in FIG. 5, is controlled by the angle of metering surface 12 relative to the radius of roller 40.

Referring to FIG. 3 of the drawing, when metering surface 12 is pivoted about the polished edge 15 from the illustrated position, wherein metering surface 12 leans toward the crest of bulge 120, in a clockwise direction as viewed in FIG. 3, to a position wherein metering surface 12 passes a line extending radially of the roller, the minimum film thickness indicated in FIG. 5 is changed. Thus by adjusting the angle between metering surface 12 and a radius of the roller, a family of curves as illustrated in FIG. 5 will be generated as illustrated in From the foregoing it should be readily apparent that the thickness of ink film 130 can be adjusted by rotating metering surface 12 about polished edge 15 or by increasing indentation of polished edge 15 into the resilient surface 44 of applicator roller 40.

It has also been observed that the thickness of film 130 can be changed by varying viscosity of ink in reservoir R. Thus by adjusting the temperature of water or other suitable liquid through tubes 7 and passage 5' in support bar 50, the viscosity of ink in reservoir R can be adjusted.

It should be noted that the minimum film thickness obtainable as a result of adjusting the angular relationship between metering surface 12 and a radius of roller 40 may result in completely removing ink from the surface of roller 40 prior to the point at which the film thickness begins to increase. Thus, to prevent damage to the surface of roller 40, the ink film thickness should be observed while adjustments are being made. When film 130 becomes very thin, applicator roller 40 should be stopped while force urging polished edge 15 into pressure indented relation with the roller is increased. After the force has been increased sufficiently to pass through the minimum film thickness threshold, the roller can be rotated without fear of loss of lubricating qualities of film 130.

FIG. 7 diagrammatically illustrates the phenomenon hereinbefore discussed which results in increasing uniformity of color density of ink on a printed sheet as the force resiliently urging edge 15 into pressure indented relation with the surface 45 on roller 40 is increased.

As hereinbefore described in the remarks relating to FIG. 10 of the drawing, color density of ink printed on a sheet was measured at points over the surface of the sheet. Maximum and minimum color density readings were recorded. Sheets were selected which were printed with different loads applied to the edge 15 on the metering member 10.

It will be noted that the variation in color density between the maximum and minimum on a sheet decreased as force urging polished edge 15 into pressure indented relation with the resilient cover 44 on roller 40 was increased, as indicated by the length of lines $D_1$, $D_2$, $D_3$ and $D_4$ in FIG. 7.

It will be appreciated that when force urging edge 15 into pressure indented relation with the surface 45 was increased, metering member 10 being a cantilever beam was deflected; the resilient cover 44 on roller 40 was deflected or indented; and edge 15 was deformed slightly along the length thereof such that the edge 15 and the surface 45 of roller 40 immediately adjacent thereto were conformed, even though edge 15 and the surface of the roller when positioned in kiss contact did not perfectly conform. Thus, deflection of metering member 10, deflection of edge 15 along the length thereof, and indentation of cover 44 all contribute to attaining the proper ink film thickness and uniformity of color density over the surface of a printed sheet.

Referring to FIGS. 5 and 7 of the drawing, it will be noted that the ink film thickness decreases to a minimum and then begins to increase as force urging edge 15 into pressure indented relation with roller surface 45 is increased. Thus, the same ink film thickness is achieved at two different points on the curve. However, as indicated by the difference in the lengths of lines $D_2$ and $D_4$ in FIG. 7 of the drawing, variation in color density is different at the two points on the curve.

Referring to FIG. 8 of the drawing, a dial indicator was attached to support bar 50 and positioned in engagement with the upper surface 19 adjacent metering surface 12 on metering member 10. As applicator roller 40 was rotated, a total dial indicator reading of 0.0006 inches was observed. This indicated that the runout in the radius of the surface of roller 40 was 0.0003 inches and that edge 15 on metering member 10 moved 0.0006 inches upon each revolution of roller 40. As the surface speed of roller 40 was increased, the magnitude of movement of edge 15 remained substantially the same at different surface speeds of roller 40. However, the total deflection of metering member 10 increased somewhat as the surface speed of roller 40 increased. Thus, the polished edge 15 on metering member 10 automatically moves relative to the axis C of applicator roller 40 upon each revolution of applicator roller 40 and in response to changes in speed of applicator roller 40.

Referring to FIG. 9 of the drawing, it will be noted that ink film thickness remained substantially constant over a broad speed range and therefore is substantially independent of the surface speed of applicator roller 40.

As hereinbefore described, the edge 15 on metering member 10 automatically moves radially as applicator roller rotates. However, metering member 10 is positioned such that metering surface 12 and polished edge 15 are rigidly supported in a tangential direction. It will be noted that force imparted to metering surface 12 as a result of ink impinging thereagainst, is directed substantially tangentially of applicator roller 40 and that metering member 10 is angularly positioned such that it is very stiff in a direction generally tangential to applicator roller 40.

While it is necessary that metering member 10 be positioned to resiliently urge edge 15 in a radial direction, metering member 10 must be of sufficient thickness to permit formation of metering surface 12 and polished edge 15 thereon. Metering member 10 should not be too thin because, when compressive force is exerted in a plane of a thin plate, it will tend to buckle and distort in much the same manner as a long, thin, axially loaded column.

The color density of ink printed onto a sheet was measured using a "SOS-40" digital reflection densitometer, commercially available from CONSARD Corporation of Garland, Tex. The color density readings of process yellow longitudinally and transversely of the printed sheet are indicated in FIG. 10 of the drawing. It will be noted that lateral color control is within a "very tight" range and that longitudinal control is also "very tight". other process colors; namely magenta, cyan and black were measured with equally good color control.

The data diagrammatically illustrated in FIG. 10 of the drawing indicates that a uniform film is being metered by metering member 10 onto the surface 45 of applicator roller 40.

It has been observed that power required for driving a printing press having the inking system hereinbefore described mounted thereon is not significantly different from power required for driving printing presses equipped with conventional inkers. However, as hereinbefore explained, the ghosted image on the surface of applicator roller 40 which is moving from plate P′ toward the entrance side of reservoir R is completely erased and a fresh film of ink is metered and offered to printing plate P′ upon each revolution of applicator roller 40. Thus, ghosting has been eliminated. Further, the metering member 10 and 10′ constructed and supported as hereinbefore described is capable of metering a film which is sufficiently thin and sufficiently uniform for inking a printing plate to provide very high quality multi-color printing. Color density can be changed immediately by merely adjusting the position of stop screw 74, which is remotely controlled.

The metering edge 15 on metering member 10, when properly formed, causes lint and other foreign matter in the ink to be rejected from the orifice formed between metering member 10 and the surface of applicator roller 40. To accomplish this function, the lead or metering surface 12 toward which the roller surface 45 is moving plays an important roll. Metering surface 12 forms a barrier above the edge 15 against which the excess ink on the applicator roller 40 impinges, creating an area of turbulence as hereinbefore described. Since the area of high pressure is formed immediately prior to movement of the ink past polished edge 15, lint and foreign matter will tend to be rejected from this area if a low pressure path is provided in the reservoir. Reservoir R is preferably at atmospheric pressure.

It has been observed that so long as metering surface 12 is maintained in a position within about 30 degrees either side of a radius of roller 40 which passes through polished edge 15, lint and foreign matter is not significantly collected adjacent polished edge 15. However, the tendency for foreign matter to collect adjacent edge 15 increases as metering surface 22 is moved in a direction toward the crest of bulge 120. Thus, metering surface 12 is also maintained at an angle to maintain an area of turbulence in the reservoir adjacent thereto. It is further noted that creation of abrupt surface 12 substantially radial prevents formation of hydrokinetic or hydrodynamic forces which would create a hydraulic pressure wedge which would tend to lift polished edge 15 and thereby cause the thickness of ink film 130 to be changed as the surface speed of roller 40 changes. Thus, edge 15 is hydrostatically supported by ink carried by roller surface 45.

From the foregoing, it should be readily apparent that ink metering member 10 and ink metering member 10′ when associated with applicator roller 40 accomplish the objects of the invention hereinbefore enumerated.

It should further be appreciated that other and further embodiments of the invention may be devised without departing from the basic concept thereof.

Having described my invention, I claim:

1. An inker for a printing press comprising: a resilient roller; a hard, generally flat, elongated metallic metering strip having an upper surface and a lower surface; a side surface on the metering strip extending between and intersecting said upper and lower surfaces, a portion of said side surface and a portion of said lower surface adjacent said side surface being polished such that said side surface and said portion of the lower surface intersect at an included angle greater than 90° at an apex to form a straight, polished, first metering edge on a polished metering surface, the lower surface of said elongated strip having a relieved area formed therein, said relieved area having a depth of at least 0.020 inch to leave a resilient metallic portion on said strip between the upper surface of the strip and the relieved area of approximately 0.030 inch and having a polished surface bounding the relieved area in the lower surface on the opposite side of the polished portion of the lower surface from the first metering edge, said polished surface bounding the relieved area in the lower surface being inclined relative to a projection of the plane of said polished portion of the lower surface at an angle of at least 30° to form a second polished edge spaced from said first metering edge; support means for supporting said metering strip cantilever fashion to position said metering strip generally tangent to and in pressure indented relation with said resilient roller, said recessed area in said metering strip being formed to prevent engagement of the metering strip with a metering film of ink on the resilient roller except by the portion of the metering strip lying between the first and second polished edges.

2. The combination of claim 1, said portion of said lower surface having a surface area sufficient to support said first metering edge to prevent penetration of an ink film carried on the surface of the resilient roller, said resilient roller having a cover which has hardness in a range between 20 and 90 shoe A durometer.

3. The combination of claim 1, said metering surface being inclined toward the oncoming surface of the resilient roller.

4. Apparatus to form a thin film of liquid on a resilient roller surface wherein a metering member is positioned such that the leading edge of the metering member is urged to indent the resilient roller surface when the metering is positioned generally tangent to the resileint roller surface, comprising: a roller having a resileint surface; a hard, generally flat elongated metallic strip having an upper surface and a lower surface; means supporting said strip generally tangent to the resilient roller surface; a side surface on the strip extending between and intersecting said upper and lower surfaces, a portion of said side surface and a portion of said lower surface adjacent said side surface being polished such that said side surface and said portion of the lower surface intersect to form at an apex a straight, polished, first mtering edge which is substantially free of surface irregularities, the lower surface of said elongated strip having a relieved area formed therein, said relieved area having a depth of at least 0.020 inch to leave a resilient metallic portion on said strip between the upper surface of the strip and the relieved area of approximately 0.030 inch and having a polished inclined surface bounding the relieved area in the lower surface on the opposite side of the polished portion of the lower surface from the first metering edge, said polished inclined surface bounding the relieved area in the lower surface being inclined relative to said polished portion the lower surface at an included angle of less than 150 degrees to form a second polished edge spaced from said first metering edge; and means rotating said resilient roller such that liquid on the surface of the roller will impinge against said polished portion of the side surface adjacent the first metering edge, said support means positioning said polished inclined surface bounding said recessed area to prevent engagement of the metering member with a metered film of liquid on said resilient roller surface except by the portion of the metering member lying between the first and second polished edges.

5. Apparatus to form a thin film of liquid on a resilient surface according to claim 4, said side surface on the strip extending between and intersecting said upper and lower surface being bevelled above said portion of the side surface which is polished.

6. Apparatus to form a thin film of liquid on a resilient roller surface which a metering member is positioned such that the leading edge of the metering member is urged to indent the resilient roller surface when the metering member is positioned generally tangent to the resiliently roller surface, comprising: a roller having a resilient surface; a hard, generally flat, elongated metallic strip having an upper surface and a lower surface; means supporting said strip cantilever fashion generally tangent to the resilient roller surface; a side surface on the strip extending between and intersecting said upper and lower surfaces, a portion of said side surface and a portion of said lower surface adjacent said side surface being polished such that said side surface and aid portion of the lower surface intersect to form an included angle of greater than 90° at an apex to form a straight, polished, first metering edge which is substantially free of surface irregularities, a polished inclined portion on the lower surface of said elongated strip forming a second polished edge spaced from said first metering edge said polished inclined portion on the lower surface being inclined relative to said polished portion of the lower surface at an included angle of less than 150 degrees; and means rotating said resilient roller such that liquid on the surface of the roller will impinge against said polished portion of the side surface adjacent the first metering edge; said support means positioning the polished portion of said side surface forming the first metering edge and the polished inclined portion of the lower surface forming the second polished edge to prevent engagement of the metering member with a metered film of liquid on said resilient roller surface formed adjacent said first metering edge except by the portion of the metering member lying between the first and second polished edges.

7. Apparatus to form a thin film of liquid on a resilient surface according to claim 4, said side surface on the strip extending between and intersecting said upper and lower surfaces being bevelled above said portion of the side surface which is polished.

8. Apparatus to form a thin film of liquid according to claim 7, with the addition of a plate cylinder having a printing plate mounted on the surface thereof; and means rotatably securing said plate cylinder such that the resilient roller surface is indented by the plate cylinder.

* * * * *

UNITED STATES PATENT AND TRADEMARK OFFICE

CERTIFICATE OF CORRECTION

PATENT NO. : 4,590,857

DATED : May 27, 1986

INVENTOR(S) : Harold P. Dahlgren

It is certified that error appears in the above-identified patent and that said Letters Patent is hereby corrected as shown below:

Col. 12, line 19, change "7" to read -- 74 --

Col. 17, line 28, after "in", second occurrence, insert -- FIG. 6 --

Col. 19, line 5, change "CONSARD" to read -- CONSAR --

Col. 20, line 47, change "shoe" to read -- shore --

Col. 21, line 27, change "which" to read -- wherein --

Col. 22, line 3, change "aid" to read -- said --

Signed and Sealed this

*Sixteenth* Day of *September 1986*

[SEAL]

*Attest:*

DONALD J. QUIGG

*Attesting Officer*

*Commissioner of Patents and Trademarks*